US009103579B2

(12) United States Patent
Lim et al.

(10) Patent No.: US 9,103,579 B2
(45) **Date of Patent: *Aug. 11, 2015**

(54) REFRIGERATOR

(71) Applicant: Samsung Electronics Co., Ltd., Suwon-si (KR)

(72) Inventors: Jae Hoon Lim, Suwon-si (KR); Jong Eun Chae, Gwangju (KR); Sun Keun Lee, Gwangju (KR); Gi Joong Jeong, Gwangju (KR); Yun Ho Yang, Yongin-si (KR); Sang Woon Jeon, Namyangju-si (KR); Jae Moon Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/301,899

(22) Filed: Jun. 11, 2014

(65) Prior Publication Data

US 2014/0292174 A1 Oct. 2, 2014

Related U.S. Application Data

(63) Continuation of application No. 14/059,805, filed on Oct. 22, 2013, now Pat. No. 8,789,903, which is a continuation of application No. 12/820,288, filed on Jun. 22, 2010, now Pat. No. 8,590,992.

(30) Foreign Application Priority Data

Jun. 22, 2009 (KR) ..... 10-2009-0055377
Nov. 3, 2009 (KR) ..... 10-2009-0105579
Jun. 18, 2010 (KR) ..... 10-2010-0058008

(51) Int. Cl.
*A47B 96/04* (2006.01)
*F25D 23/00* (2006.01)

(Continued)

(52) U.S. Cl.
CPC ..... *F25D 23/00* (2013.01); *A47B 88/20* (2013.01); *A47B 96/04* (2013.01); *F25D 11/00* (2013.01); *F25D 23/028* (2013.01);

(Continued)

(58) Field of Classification Search
CPC A47F 5/0056; A47B 88/20; A47B 2088/202; A47B 2088/205; A47B 57/583; A47B 57/585; A47B 57/586; A47B 57/588; F25D 25/025
USPC ..... 312/348.3, 402, 404, 350, 408, 410; 220/534, 544, 552; 211/184
See application file for complete search history.

(56) References Cited

U.S. PATENT DOCUMENTS 2,169,562 A 8/1939 Lombardini
2,914,211 A 11/1959 Deinlein et al.

(Continued)

OTHER PUBLICATIONS

Restriction Requirement mailed Aug. 16, 2012 in U.S. Appl. No. 12/820,288.

(Continued)

*Primary Examiner* — Hanh V Tran
(74) *Attorney, Agent, or Firm* — Staas & Halsey LLP

(57) ABSTRACT

A refrigerator including an extractable container, and a conveying unit formed in an inner space of a vertical wall of the extractable container. The conveying unit includes a guide part to guide the movement of a partition member that divides a storage space of the extractable container, and a fixing part to restrict the movement of the partition member.

5 Claims, 21 Drawing Sheets

(51) Int. Cl.

| | |
|---|---|
| ***A47B 88/20*** | (2006.01) |
| ***F25D 25/02*** | (2006.01) |
| ***F25D 11/00*** | (2006.01) |
| ***F25D 23/02*** | (2006.01) |
| ***F25D 23/06*** | (2006.01) |

(52) U.S. Cl.
CPC ..... *F25D 23/065* (2013.01); *F25D 25/025* (2013.01); *F25D 2325/021* (2013.01)

(56) References Cited

U.S. PATENT DOCUMENTS

| | | | |
|---|---|---|---|
| 4,527,694 | A | 7/1985 | Bolt et al. |
| 5,269,600 | A | 12/1993 | Arreola et al. |
| 5,366,283 | A | 11/1994 | Crose |
| 5,813,566 | A | 9/1998 | Bradford et al. |
| 6,871,921 | B2 | 3/2005 | Ernst |
| 6,938,784 | B2 | 9/2005 | Yang |
| 7,296,433 | B2 | 11/2007 | Uihlein et al. |
| 2006/0278646 | A1 | 12/2006 | Bradford |
| 2007/0126325 | A1 | 6/2007 | Gorz et al. |

OTHER PUBLICATIONS

Office Action mailed Oct. 9, 2012 in U.S. Appl. No. 12/820,288.
Office Action mailed Mar. 27, 2013 in U.S. Appl. No. 12/820,288.
Notice of Allowance mailed Oct. 23, 2013 in U.S. Appl. No. 12/820,288.
Office Action mailed Dec. 6, 2013 in U.S. Appl. No. 14/059,805.
Notice of Allowance mailed Mar. 20, 2014 in U.S. Appl. No. 14/059,805 with attached Examiner-Initiated Interview Summary.
U.S. Appl. No. 14/059,805, filed Oct. 22, 2013, Jae Hoon Lim et al, Samsung Electronics Co., Ltd.
U.S. Appl. No. 12/820,288, filed Jun. 22, 2010, Jae Hoon Lim et al, Samsung Electronics Co., Ltd.

REFRIGERATOR

CROSS-REFERENCE TO RELATED APPLICATIONS

This application is a continuation of and claims the benefit of U.S. patent application Ser. No. 14/059,805 filed Oct. 22, 2013, which is a continuation of and claims the benefit of U.S. patent application Ser. No. 12/820,288 filed Jun. 22, 2010 in the United States Patent and Trademark Office, which claims the benefit of Korean Patent Application Nos. 10-2009-0055377, filed on Jun. 22, 2009, 10-2009-0105579, filed on Nov. 3, 2009, and 10-2010-0058008, filed on Jun. 18, 2010, in the Korean Intellectual Property Office, the disclosures of which are incorporated herein by reference.

BACKGROUND

1. Field

Embodiments relate to a refrigerator having an extractable container equipped with a partition unit which divides a storage space formed in the extractable container into a proper size.

2. Description of the Related Art

Generally, a refrigerator refers to a device to store food fresh at a low temperature by supplying cold air to a food storage chamber. The food storage chamber includes a freezing chamber maintaining a temperature below freezing and a refrigerating chamber maintaining a temperature slightly above freezing.

Due to the large variety of food, the refrigerator has an increased storage space. Such an enlarged refrigerator may be equipped with an extractable container which is withdrawably connected and adapted to store vegetables and fruits.

The extractable container holds a storage space therein to store foodstuffs. Recently, extractable containers have been designed to have a storage space divided such that different types of food are well organized in the storage space without being randomly mixed.

SUMMARY

Therefore, it is an aspect to provide a refrigerator having an extractable container equipped with a partition unit dividing a storage space thereof in a variable manner.

Additional aspects will be set forth in part in the description which follows and, in part, will be apparent from the description, or may be learned by practice of the invention.

The foregoing and/or other aspects are achieved by providing a refrigerator including a main body having a storage chamber, a door opening and closing the storage chamber, an extractable container withdrawably mounted in the storage chamber and having a vertical wall and a storage space defined by the vertical wall, and a partition unit including a partition member which divides the storage space of the extractable container, wherein the partition member includes a lateral partition movable in forward and backward directions of the storage space, and a longitudinal partition movable in left and right directions of the storage space, the longitudinal partition intersecting the lateral partition, wherein the partition unit further includes a conveying unit to guide movement of the partition member, the conveying unit being provided in a space defined inside the vertical wall.

The conveying unit may include a guide part to guide the movement of the partition member, and a fixing part to fix the partition member.

The lateral partition and the longitudinal partition each may include a pair of horizontal rods vertically spaced and facing each other, and a pair of vertical rods connecting both ends of the respective horizontal rods, thereby forming a rectangular closed curve.

The guide part may include a guide rail and a moving block slidably connected to the guide rail, and the fixing part may include an uneven surface part formed on the guide rail and an elastic fixing member formed at the moving block to be moved along the uneven surface part.

The elastic fixing member may include an elastic projection made of an elastic material.

The refrigerator may further include a projection recess in the moving block. The elastic fixing member may include a pressing projection moving in and out of a projection recess formed at the moving block, and an elastic member elastically biasing the pressing projection toward the uneven surface part.

The guide part may include a guide rail formed with a guide groove, and a roller connected to the partition member to be movable along the guide groove, and the fixing part may include an uneven surface part formed at the guide groove.

The partition member may include a connection projection formed at both sides to be engaged with the conveying unit, and the vertical wall may include a guide slot into which the connection projection of each side is inserted The vertical wall may include an opening mounting the conveying unit, and a sealing cover closing the opening and having a guide slot into which a connection projection formed at the partition member is inserted.

The refrigerator may further include a handle part disposed at an intersection between the lateral partition and the longitudinal partition to guide the lateral partition in the forward and the backward directions and the longitudinal partition in the left and the right directions.

The foregoing and/or other aspects may be achieved by providing a refrigerator including a storage chamber, an extractable container withdrawably mounted to the storage chamber and including a storage space and a vertical wall forming the storage space the vertical wall having an opening, and a partition unit provided in the extractable container to divide the storage space, wherein the partition unit includes a partition member a lateral partition mounted to be movable in forward and backward directions in the storage space, and a longitudinal partition mounted across the lateral partition to be movable in left and right directions in the storage space, a conveying unit mounted in an inner space of the vertical wall through an opening formed on the vertical wall so as to guide and restrict the movement of the partition member, and a sealing cover closing the opening.

The conveying unit may include a guide rail fixed to the inner space of the vertical wall and provided with an uneven surface part at one side thereof; a moving block engaged with the connection projection to be slid along the guide rail; and an elastic fixing member formed at the moving block to move along the uneven surface part.

The foregoing and/or other aspects may be achieved by providing a refrigerator including a storage chamber, an extractable container withdrawably mounted to the storage chamber and including a vertical wall forming a storage space, a partition unit including a partition member to divide the storage space, and a conveying unit formed in an inner space of the vertical wall to guide movement of the partition member, the conveying unit not being exposed into the storage space.

The vertical wall may include a step extended from the vertical wall, outer and inner side walls respectively extended upward from opposite ends of the step, and a receiving groove formed between the outer and inner side walls. The conveying unit may be seated in the receiving groove while being arranged in an inner space of the vertical wall by a cover member coupled to a top of the extractable container.

The conveying unit may include guide members to guide the movement of the partition member, and sliding members slidably coupled to the guide members while being respectively coupled to opposite ends of the lateral and longitudinal partitions.

The foregoing and/or other aspects may be achieved by providing a refrigerator including a storage chamber, a drawer type door slidably movable to open or close the storage chamber, an extractable container detachably mounted to the drawer type door, the extractable container including a vertical wall having inner and outer side walls spaced apart from each other, and a receiving groove defined between the inner and outer side walls, and a storage space defined by the vertical wall, a partition unit including a rectangular frame centrally opened and seated in the receiving groove, a first partition member crossing the storage space in a first direction with both ends thereof supported by the first facing sidewalls of the rectangular frame, a second partition member crossing the storage space in a second direction intersecting the first direction with both ends thereof supported by the second facing sidewalls of the rectangular frame, a plurality of slide members respectively formed at both ends of the first and the second partition members, and a plurality of guide members respectively formed at the first and the second sidewalls of the rectangular frame, and a cover member coupled to a circumference of the vertical wall, to cover a top of the receiving groove, thereby preventing the rectangular frame seated in the receiving groove from being outwardly exposed.

The cover member may include at least one support rib to press one side of the rectangular frame seated in the receiving groove.

The guide members each may include a guide groove extended along a horizontal length of the rectangular frame, and the slide members each may include a roller received in the guide groove to be in rolling-contact with an inside of the guide groove.

The first and the second partition members each may include horizontal rods spaced vertically and facing each other, and vertical rods connecting both ends of the respective horizontal rods, thereby forming a rectangular closed curve. The slide member may include connection parts to which the vertical rods are connected.

The inner side wall may be provided with guide slots formed at upper ends of respective sides of the inner side wall, the guide slots being upwardly opened while being horizontally extended. The opened upper portions of the guide slots may be closed by the cover member. The connection parts may be protruded through the guide slots, respectively.

The foregoing and/or other aspects may be achieved by providing a refrigerator including a storage chamber, a vertical wall withdrawably arranged in the storage chamber, an extractable container having a storage space defined by the vertical wall, and a partition unit including first and second partition members to divide the storage space into at least four spaces, the first partition member being movable in a first direction of the storage space, the second partition member being movable in a second direction of the storage space while intersecting the first partition member, wherein the partition unit further includes a frame including guide members coupled to sliding members respectively provided at opposite ends of the first and second partition members, to guide the first and second partition members to be stably movable, the guide members guiding rectilinear movement of the sliding members, the vertical wall includes a step extended from a circumference of the vertical wall, outer and inner side walls respectively extended upward from opposite ends of the step, and a receiving groove formed between the outer and inner side walls, to receive the frame, and the refrigerator further includes a cover member coupled to the vertical wall, to cover an opened portion of the receiving groove.

The guide members each may include a guide groove extended along a horizontal length of the frame, and the slide members each may include a roller received in the guide groove to be in rolling contact with an inside of the guide groove.

The refrigerator may further include sliding units provided at opposite side walls of the storage chamber, respectively; and a drawer type door including seat frames respectively coupled to the sliding units, to open or close the storage chamber. The extractable container may be detachably mounted to the seat frames.

The partition unit may include a single assembly seated in the receiving groove.

The cover member may include at least one support rib to press one side of the frame seated in the receiving groove, thereby restricting movement of the frame.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
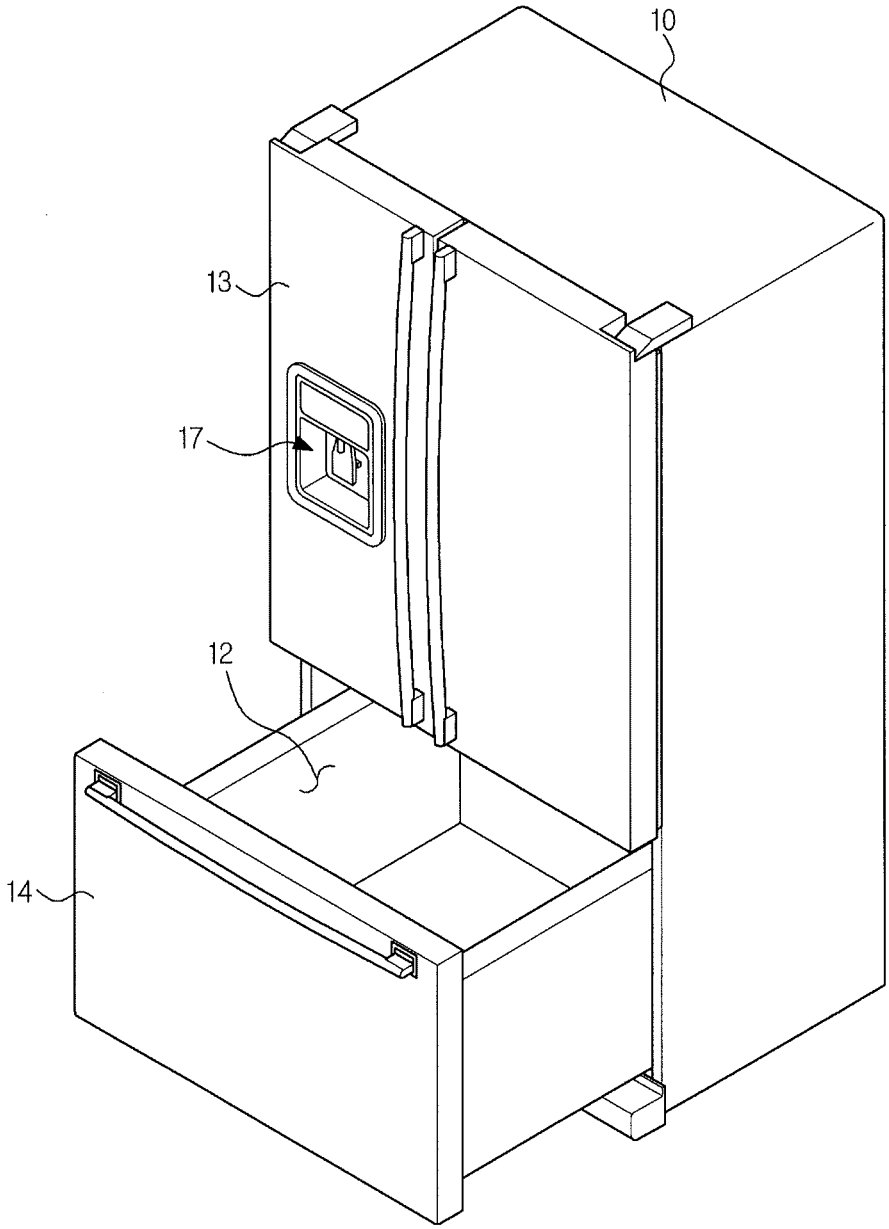
FIG. 1 is a perspective view schematically showing the external appearance of a refrigerator according to an embodiment.

Reference will now be made in detail to the embodiments, examples of which are illustrated in the accompanying drawings, wherein like reference numerals refer to like elements throughout.

Figure 2:
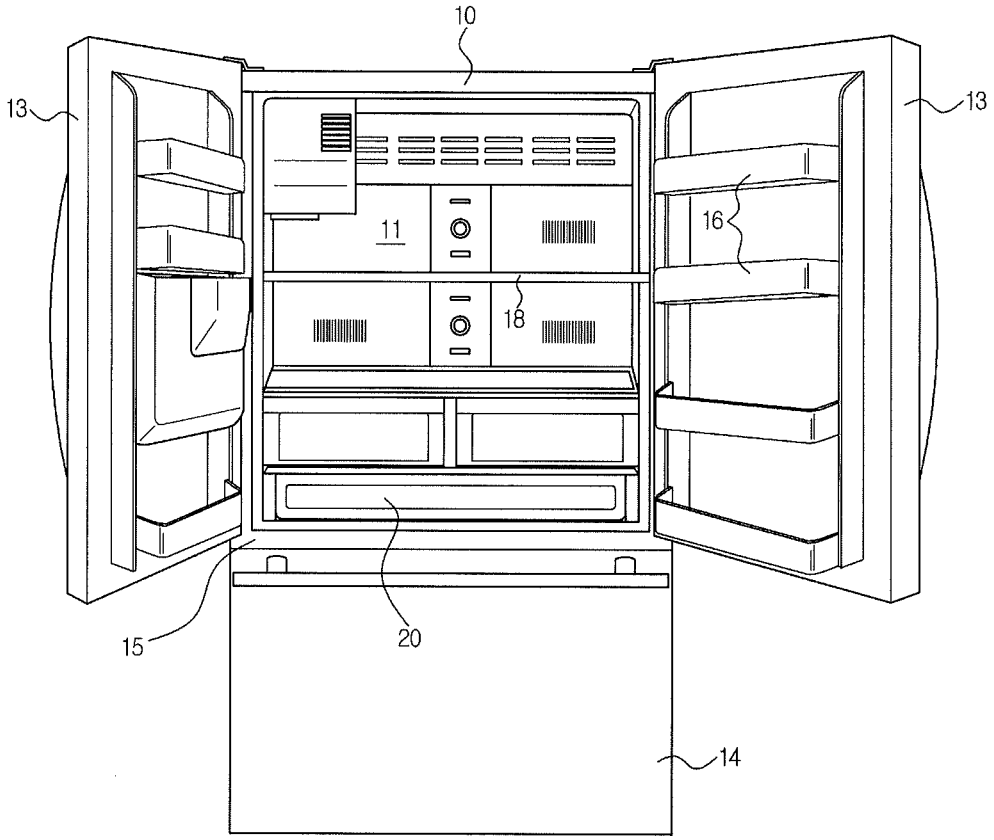
FIG. 2 is a perspective view showing the inside of the refrigerator according to the embodiment.

FIG. 1 is a perspective view schematically showing the external appearance of a refrigerator according to an embodiment. FIG. 2 is a perspective view showing the inside of the refrigerator.

Referring to FIG. 1 and FIG. 2, a refrigerator according to the embodiment includes a main body 10 having storage chambers 11 and 12, and doors 13 and 14 opening and closing a front side of the main body 10.

The storage chambers 11 and 12 include a refrigerating chamber 11 and a freezing chamber 12 disposed respectively at a lower part and an upper part with respect to a lateral partition 15 which divides the inside of the main body 10 into upper and lower parts.

The doors 13 and 14 include a refrigerating chamber door 13 opening and closing the refrigerating chamber 11, and a freezing chamber door 14 opening and closing the freezing chamber 12.

A plurality of door guards 16 are formed on the inside of the refrigerating chamber door 13 to store beverage bottles and relatively small items.

Additionally, a dispenser 17 may be mounted to the refrigerating chamber door 13 to enable a user to obtain water or ice from the outside.

The refrigerating chamber 11 includes a plurality of shelves 18 disposed at an upper part thereof, and a plurality of extractable containers 20 withdrawably mounted at a lower part thereof. The extractable containers 20 each have a storage space to store food such as vegetables and fruits.

The extractable container 20 according to the embodiment is inserted in and withdrawn from the inside of the storage chamber, but is not limited to such a structure. For example, the whole front side of the extractable container 20 may define the refrigerator door so that the extractable container 20 can be withdrawn from the outside.

Figure 3:
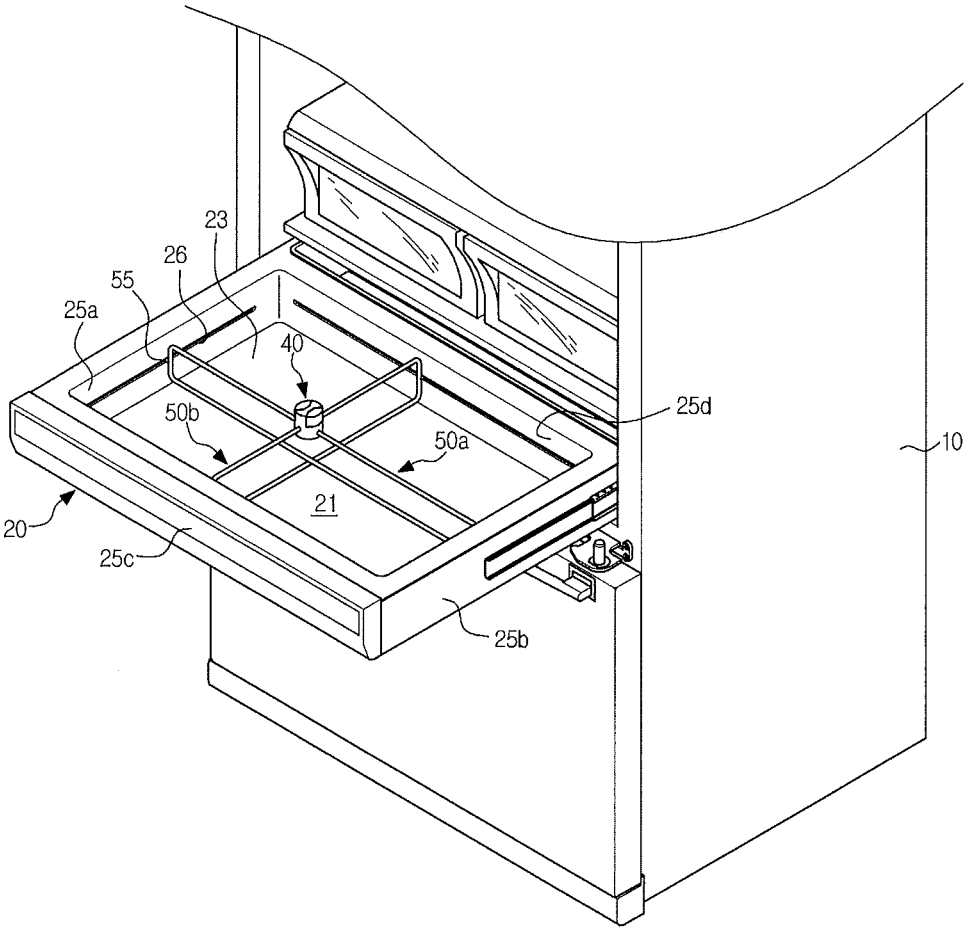
FIG. 3 is a perspective view showing an extractable container withdrawn from the refrigerator.
Figure 4:
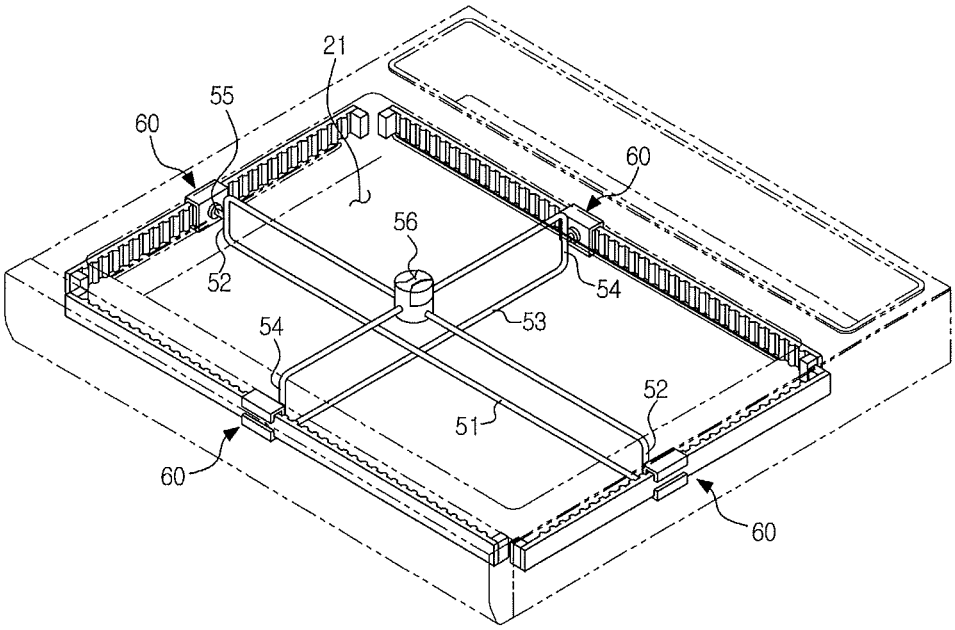
FIG. 4 is a perspective view showing the extractable container of the refrigerator.
Figure 5:
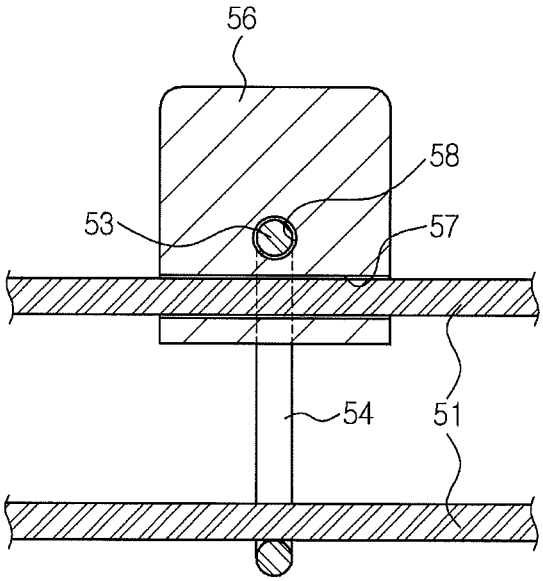
FIG. 5 is a sectional view showing a handle part of a partition unit according to the embodiment.

FIG. 3 is a perspective view showing an extractable container being withdrawn from the refrigerator. FIG. 4 is a perspective view showing the extractable container of the refrigerator. FIG. 5 is a sectional view showing a handle part of a partition unit of the extractable container.

Referring to FIGS. 3 and 4, the extractable container 20 includes a bottom surface 23 and a vertical wall extended upward from an outer circumference of the bottom surface 23, thereby forming a storage space to store food. Thus, the extractable container 20 has a hexahedral shape opened to the upper part.

The vertical wall includes two sidewalls 25*a* and 25*b* extended upward from both sides of the bottom surface 23, and a front wall 25*c* and a rear wall 25*d* extended upward from the front and the rear of the bottom surface 23, respectively.

Figure 10:
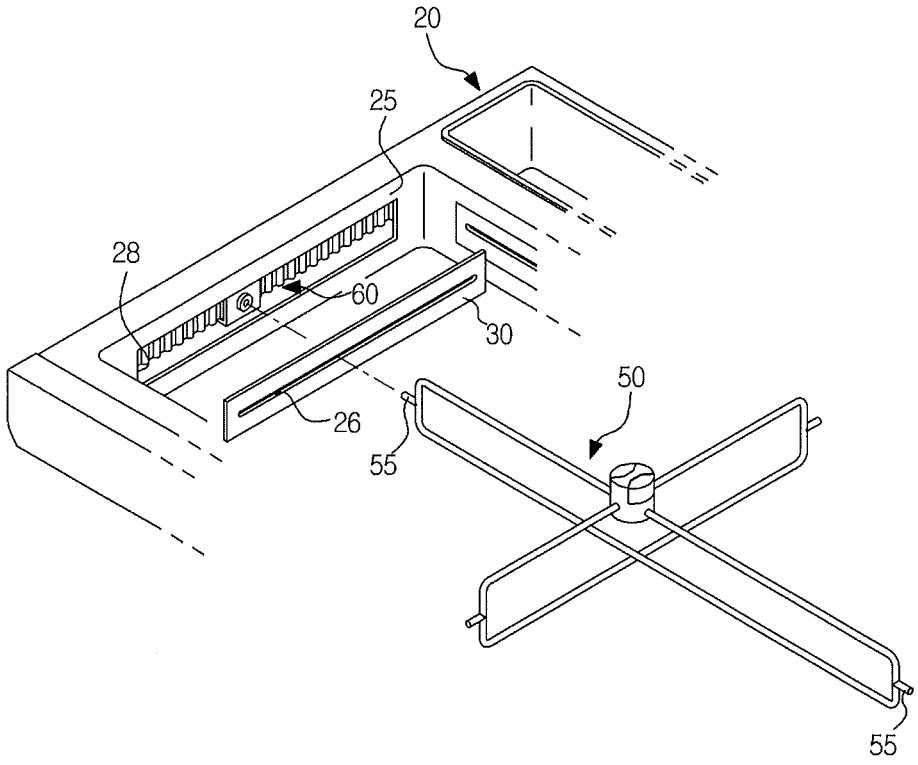
FIG. 10 is a perspective view of an extractable container according to another embodiment.

A guide slot 26 is formed on each side of the vertical wall 25, being extended in a lateral direction and connected with a conveying unit 60 and a partition member 50 that will be described later. The guide slot 26 may be formed integrally with the vertical wall 25. Alternatively, as shown in FIG. 10, the guide slot 26 may be formed at a sealing cover 30 that seals an opening 28 which is formed on each side of the vertical wall 25 to mount of the conveying unit 60.

A partition unit 40 is disposed in a storage space 21 to divide the storage space 21 into a plurality of areas. The partition unit 40 may include the partition member 50 that divides the storage space 21 into two or more separate spaces in the forward and the backward directions and in the left and the right directions.

More specifically, the partition member 50 may include a lateral partition 50*a* dividing the storage space 21 forward and backward, and a longitudinal partition 50*b* dividing the storage space 21 to the left and the right.

The partition member 50 may include pairs of horizontal rods 51 and 53, each pair of which includes upper and lower horizontal rods spaced to face each other, and pairs of vertical rods 52 and 54, each pair of which connects both ends of the respective horizontal rods 51 and 53. Accordingly, the partition member 50 forms rectangular closed curves each having a pair of long sides and a pair of short sides.

The horizontal rods 51 and 53 and the vertical rods 52 and 54 may be formed by bending a wire or a pipe having a sufficient strength.

Lengths of the horizontal rods 51 of the lateral partition 50*a* may be slightly smaller than a distance between the sidewalls 25*a* and 25*b* of the extractable container 20. Lengths of the vertical rods 53 of the longitudinal partition 50*b* may be slightly smaller than a distance between the front wall 25*c* and the rear wall 25*d* of the extractable container 20.

Lengths of the vertical rods 52 and 54 may be almost the same as the height of the extractable container 21. Also, a connection projection 55 may be extended outward from the middle of the respective vertical rods 52 and 54, to be engaged with the conveying unit 60 that will be described later.

The connection projection 55 is inserted in the guide slot 26 formed on the vertical wall 25, thereby being engaged with the conveying unit 60.

In addition, a handle member 56 may be formed at an intersection between the lateral partition 50*a* and the longitudinal partition 50*b*, so as to guide the movement of the lateral partition 50*a* forward and backward or the longitudinal partition 50*b* to the left and the right.

As shown in FIG. 5, the handle member 56 has a substantially cylindrical form and includes rod connection holes 57 and 58 into which upper ones of the horizontal rods 51 and 53 of the lateral partition 50*a* and the longitudinal partition 50*b* are inserted.

More specifically, the rod connection holes 57 and 58 are divided into a first rod connection hole 57 opened in the left and the right directions to insert the upper horizontal rod 51 of the lateral partition 50*a*, and a second rod connection hole 58 disposed at an upper part of the first rod connection hole 57 and opened in the forward and backward directions to insert the upper horizontal rod 53 of the longitudinal partition 50*b* intersecting the lateral partition 50*a*.

Thus, when the handle member 56 is moved to the left and the right, the longitudinal partition 50*b* is moved to the left and the right along the horizontal rod 51 of the lateral partition 50*a*. When the handle member 56 is moved forward and backward, the lateral partition 50*a* is moved forward and backward along the horizontal rod 53 of the longitudinal partition 50*b*.

Additionally, the partition unit 40 may include the conveying unit 60 to move and fix the partition member 50.

Figure 8:
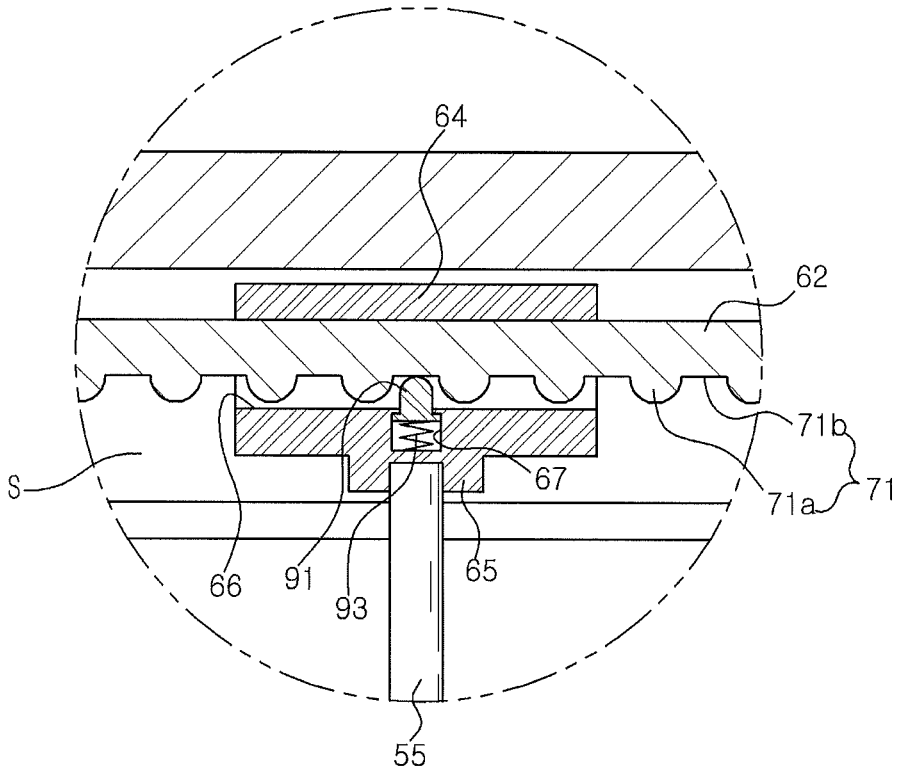

The conveying unit 60 is disposed on an inner space S of each side of the vertical wall 25 defining the storage space 21 (refer to FIG. 8). Both sides of each partition member 50 are engaged with the corresponding pair of conveying units 60.

Accordingly, the partition member 50 is stably operated while the aesthetics thereof are improved since the conveying unit 60 is not seen from the outside. Also, the storage space 21 may be efficiently used as a storage space.

Furthermore, the extractable container 20 may be protected from frictional scratches that may be caused on an inner surface of the vertical wall 25 by the movement of the partition member 50.

The conveying unit 60 may include a guide part 61 guiding the movement of the partition member 50, and a fixing part restricting the movement of the partition member 50 by fixing the partition member 50.

Figure 6:
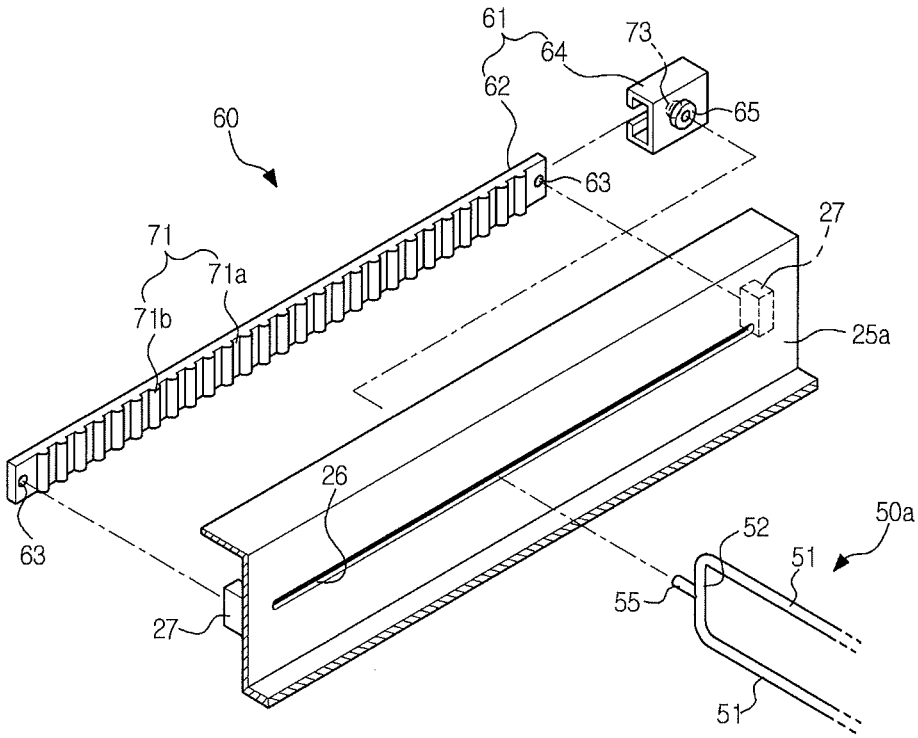
FIG. 6 is a view showing a conveying unit provided at one sidewall within a storage space of the extractable container.

FIG. 6 is a view showing a conveying unit provided at one sidewall in the storage space of the extractable container.

As shown in FIG. 6, the conveying unit 60 is formed in the inner space of one sidewall 25*a* of the extractable container 20 to guide the movement of the partition member 50. The guide part 61 of the conveying unit 60 includes a guide rail 62 fixed to the inner surface of the sidewall 25*a* and a moving block 64 slidably coupled with the guide rail 62.

The guide rail 62 has a rectangular form extended in the forward and the backward directions and includes connection parts 63 formed on both sides thereof for connection with a rail fixing device 27 formed on the inner surface of the sidewall 25*a*.

The moving block 64 encloses an outer side of the guide rail 62, and includes a connection projection coupling part 65 coupled with the connection projection 55 of the partition member 50.

The fixing part of the conveying unit 60, restricting the movement of the partition member 50, may include an uneven surface part 71 including pluralities of fixing grooves 71*a* and fixing ridges 71*b* formed on one surface of the guide rail 62, and an elastic fixing member 73 formed at the moving block 64 to advance and recede along the shape of the uneven surface part 71.

The elastic fixing member 73 may be implemented by any member capable of elastically advancing and receding according to the shape of the fixing grooves 71*a* and the fixing ridges 71*b*. Hereinafter, various versions of the elastic fixing member 73 will be explained in detail.

Figure 7:
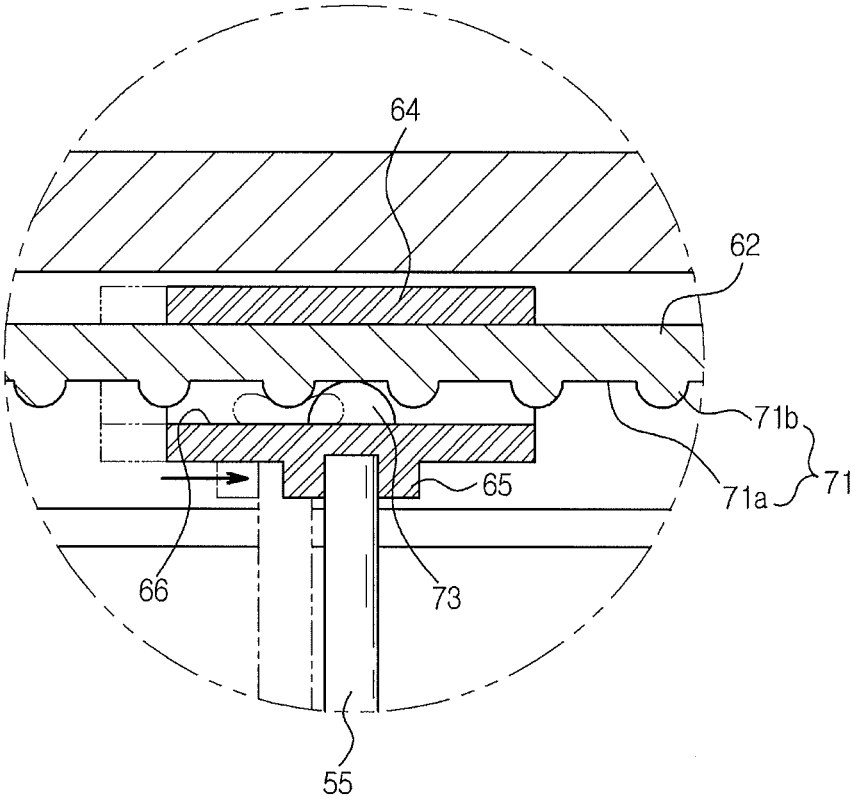
FIG. 7 and FIG. 8 are sectional views showing an elastic fixing member formed at the conveying unit according to the embodiment.

FIG. 7 and FIG. 8 are sectional views showing the elastic fixing member formed at the conveying unit according to the embodiment.

Referring to FIG. 7, the elastic fixing member 73 of the fixing part may include a projection made of an elastic material and disposed on an inner surface 66 of the moving block 64 facing the uneven surface part 71 of the guide rail 62.

Accordingly, as the moving block 64 is moved in the direction indicated by arrows in FIG. 7, the elastic projection of the elastic fixing member 73 advances and recedes by being deformed according to the shape of the fixing ridges and grooves 71*b* and 71*a*.

Figure 9:
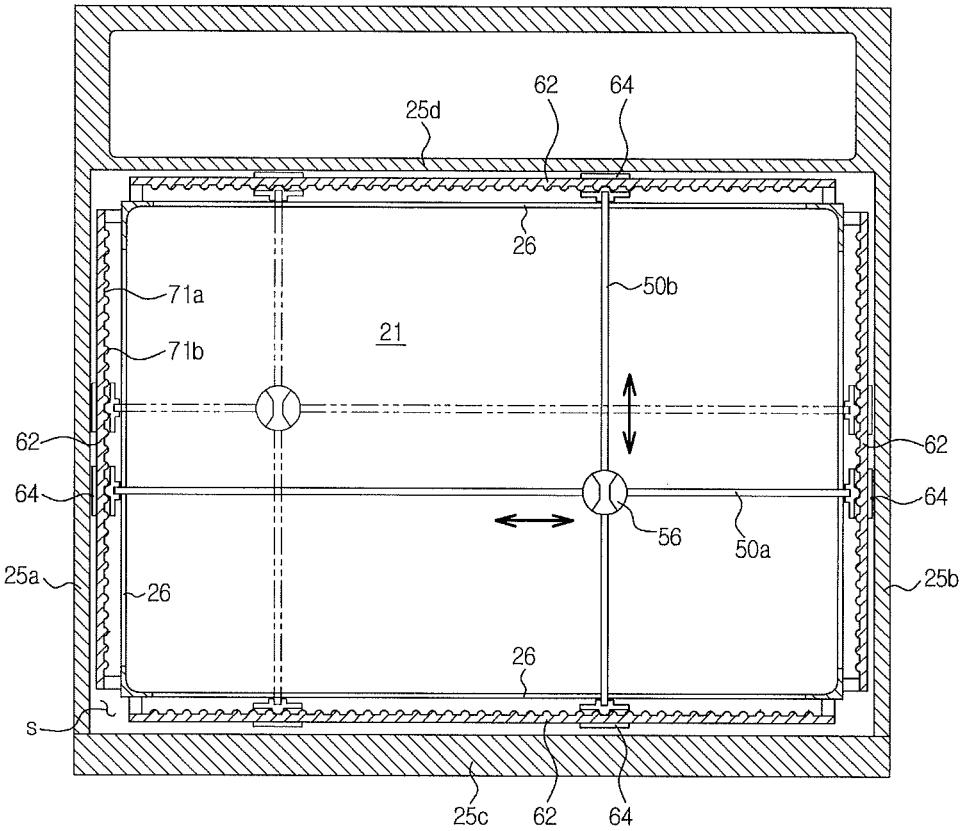
FIG. 9 is a sectional view showing the operation of the partition unit.

Therefore, when the elastic projection is inserted in any of the fixing grooves 71*a*, the moving block 64 is maintained in a fixed state unless external force is applied. Thus, the partition member 50 is able to divide the storage space 21 by moving step by step in connection with the moving block 64, as shown in FIG. 9.

Referring to FIG. 8, the elastic fixing member of the fixing part may include a pressing projection 91 and an elastic member 93. The pressing projection 91 moves in and out of a projection recess 67 formed in the center of the inner surface 66 of the moving block 64 facing the uneven surface part 71 formed at the guide rail 62. The elastic member 93 elastically biases the pressing projection 91 toward the uneven surface part 71.

The embodiment has been described in a manner that the conveying unit 60 which has the guide part 61 guiding the movement of the partition member 50 and the fixing part restricting the movement of the partition member 50 is disposed in the inner space on the vertical wall 25. However, the conveying unit 60 may be mounted on an outer surface of the vertical wall 25.

Figure 11:
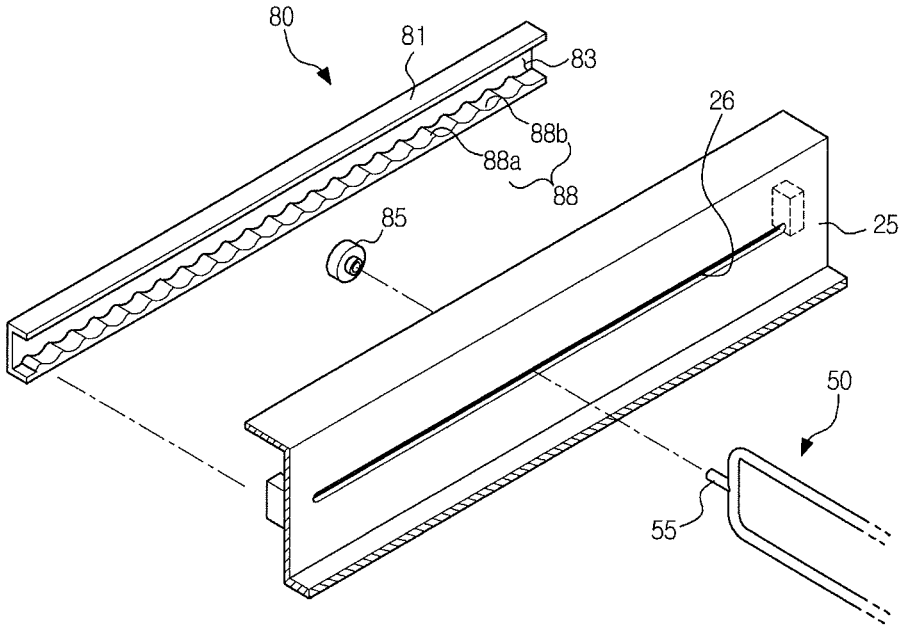
FIG. 11 is an exploded perspective view of the conveying unit according to the embodiment of FIG. 10.
Figure 12:
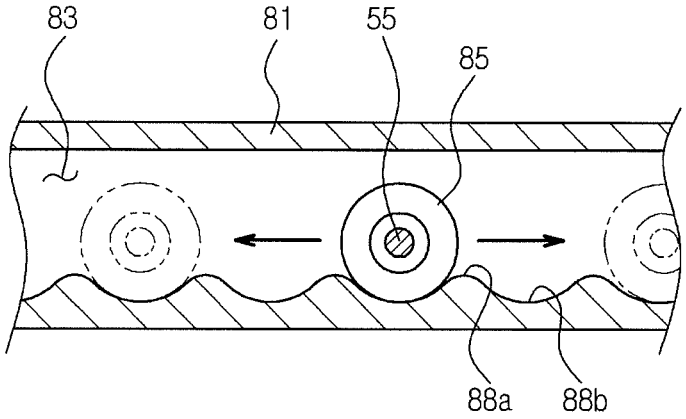
FIG. 12 is a sectional view showing the operation of the conveying unit according to the embodiment of FIG. 10.

FIG. 11 is an exploded perspective view of a conveying unit according to another embodiment. FIG. 12 is a sectional view showing the operation of the conveying unit of FIG. 11.

Referring to FIG. 11, a guide part 80 of the conveying unit according to this embodiment includes a guide rail 81 having a guide groove 83, and a roller 85 rotatably connected to the connection projection 55 of the partition member 50 to be inserted and moved in the guide groove 83.

The fixing part that restricts the movement of the partition member 50 includes an uneven surface part 88 disposed at a lower part of the guide groove 83 that supports the roller 85 and including a plurality of fixing prominences 88*a* and fixing recesses 88*b*.

As shown in FIG. 11, according to this structure, the partition member 50 is restrained from moving when the roller 85 is caught in the fixing recesses 88*b*, and is moved beyond the fixing prominences 88*a* when a predetermined external force is applied to move the partition member 50.

Figure 13:
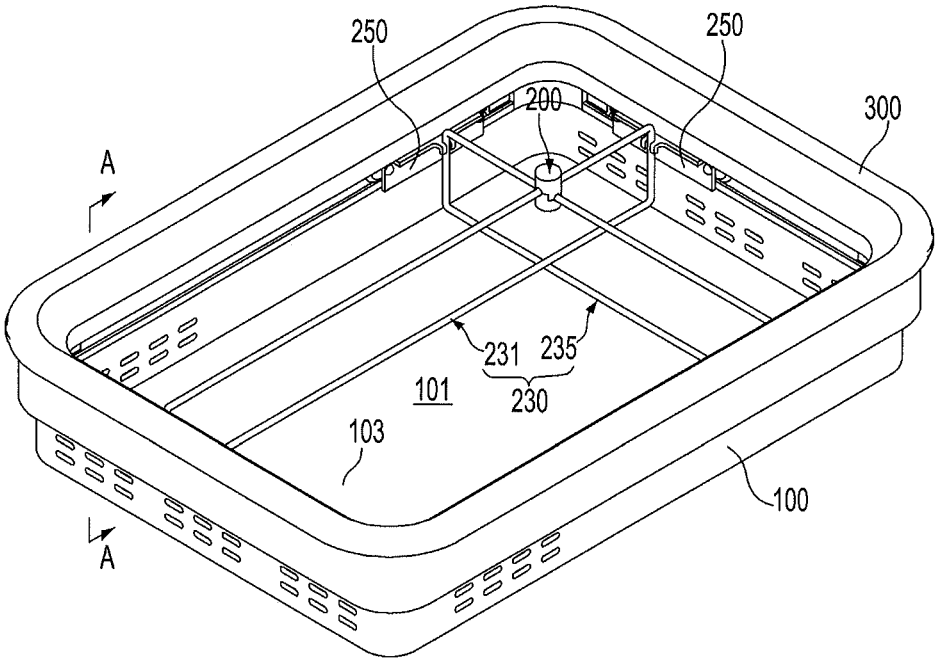
FIG. 13 is a view showing an extractable container with a partition unit according to still another embodiment.
Figure 14:
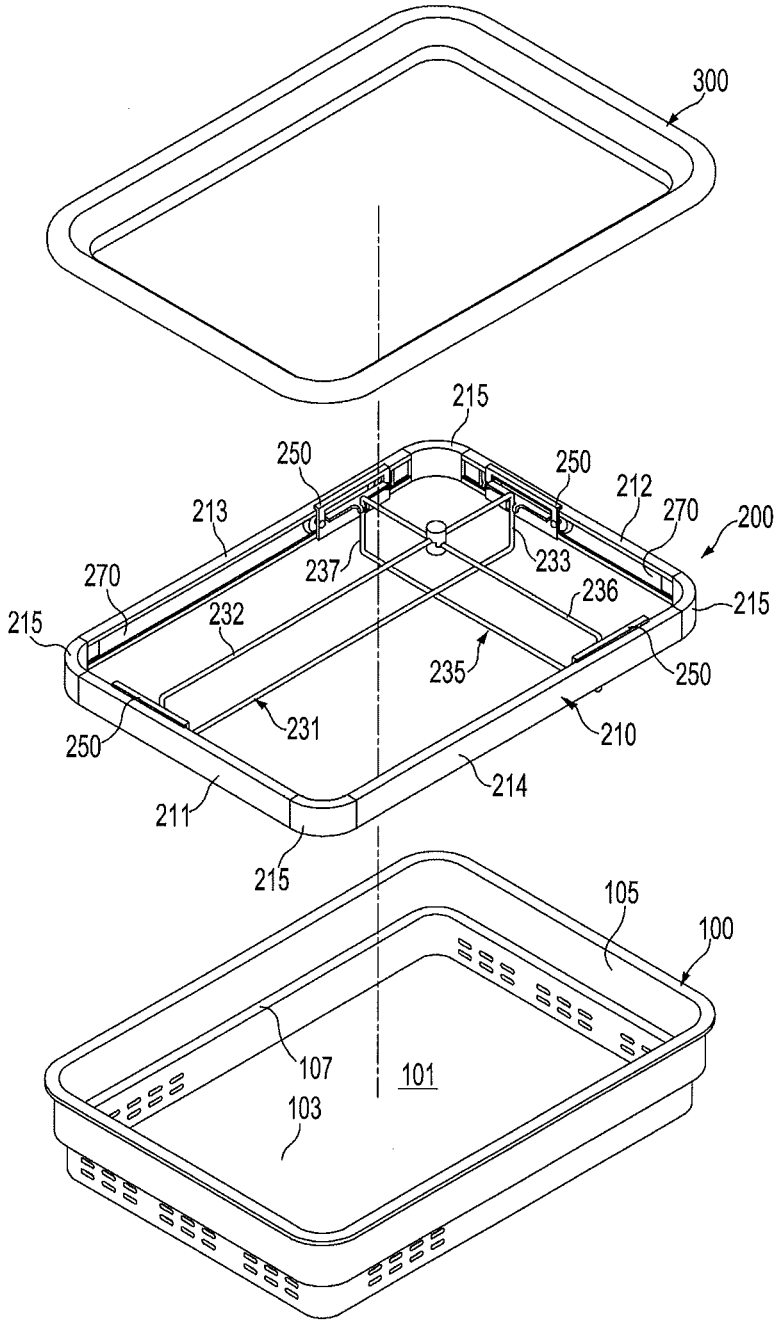
FIG. 14 is an exploded perspective view of the extractable container with a partition unit according to the embodiment of FIG. 13.
Figure 15:
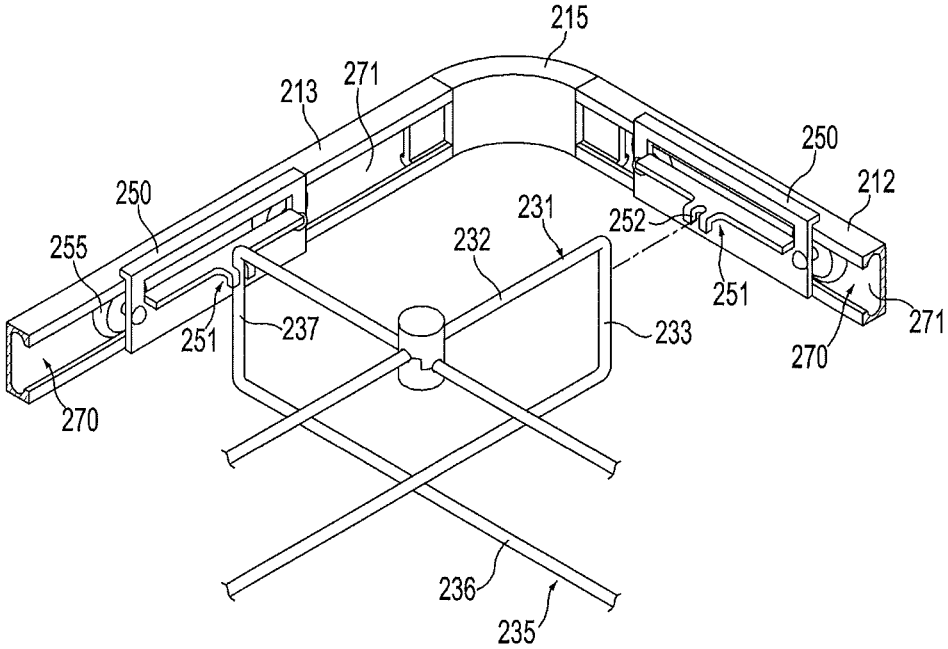
FIG. 15 is a view showing the relationship between a partition member and a slide member of the partition unit, according to the embodiment of FIG. 13.

FIG. 13 is a view showing an extractable container with a partition unit according to still another embodiment. FIG. 14 is an exploded perspective view of the extractable container with a partition unit according to the embodiment of FIG. 13. FIG. 15 is a view showing the relationship between a partition member and a slide member of the partition unit, according to the embodiment of FIG. 13.

Referring to FIGS. 13 and 14, a partition unit 200 is equipped with a partition member 230 that divides a storage space 101 of an extractable container 100 into at least four spaces. The partition unit 200 may be formed into a single assembly so as to be efficiently mounted in the extractable container 100 and to improve the stability of movement of the partition member 230.

For this purpose, the partition unit 200 may include a frame 210 opened through the center and shaped corresponding to an outer circumference of the storage space 101 of the extractable container 100. Specifically, the frame 210 may have a shape corresponding to an outer circumference of a vertical wall 105 extended upward from an outer circumference of a bottom surface 103, thereby forming the storage space 101.

The frame 210 may include two first sidewalls 211 and 212 facing each other in a first direction, that is, a longitudinal direction, and two second sidewalls 213 and 214 facing each other in a second direction intersecting the first direction, that is, a lateral direction. The first and the second sidewalls 211, 212, 213 and 214 are connected to one another at ends thereof by connection members 215, accordingly forming a substantially rectangular frame.

In addition, the partition unit 200 may include the partition member 230 that divides the inside of the frame 210 opened through the center into at least four spaces.

To this end, the partition member 230 may include a first partition member 231 supported by the first sidewalls 211 and 212 at both ends thereof, thereby crossing the inside of the frame 210 in the first direction (longitudinal direction), and a second partition member 235 supported by the second sidewalls 213 and 215 at both ends thereof, thereby crossing the inside of the frame 210 in the second direction (lateral direction).

The first partition member 231 and the second partition member 235 may respectively include pairs of horizontal rods 232 and 236 spaced upward and downward to face each other, and pairs of vertical rods 233 and 237 respectively connecting both ends of the horizontal rods 232 and 236, thereby forming a rectangular closed curve.

The first and the second partition members 231 and 235 are arranged across each other and supported by the frame 210 at both ends thereof to be linearly movable.

A slide member 250 is connected to the vertical rods 233 and 237 formed at both ends of the first and the second partition members 231 and 235. The frame 210 may include guide members 270 to which the slide members 250 are movably connected. The guide members 270 stably guide the linear movements of the slide members 250.

The guide members 270 are formed of a relatively high strength material so as not to be deformed or shaken during the movement of the slide members 250. The guide members 270 may be connected to the frame 210, or integrally formed with the frame 210 by forming the frame 210 by injection molding a relatively high strength material such as aluminum.

According to this structure, although the extractable container 100 made of plastic is deformed, the partition member 230 is linearly guided along the guide members 270 of the frame 210 and therefore moved stably without shaking.

Referring to FIG. 15, the slide members 250 may be substantially rectangular plates provided to the vertical rods 233 and 237 of the first and the second partition members 231 and 235. The slide members 250 may be separately formed and then connected to the partition member 230.

For this, the slide members 250 may each include a connection part 251 formed at one side thereof to be connected with the vertical rods 233 and 237 of the first and the second partition members 231 and 235.

The connection part 251 may have any configurations enabling removable connection of the slide member 250 to the partition member 230. For example, as shown in FIG. 15, the connection part 251 may include a force-fit clamp 252 opened upward and downward for force-fit engagement with the vertical rods 233 and 237 of the partition members 231 and 235.

Connection between the partition 230 and the slide members 250 may be conveniently achieved by force-fitting the vertical rods 233 and 237 of the partition member 230 in the force-fit clamps 252 of the slide members 250.

In addition, since the force-fit clamps 252 are opened upward and downward, the force-fitting positions of the vertical rods 233 and 237 may be freely adjusted along the length of the vertical rods 233 and 237. Accordingly, the mounting height of the partition member 230 in the storage space 101 of the extractable container 100 may be adjusted.

That is, the user is able to adjust the height of the partition member 230 simply by adjusting the force-fitting positions of the vertical rods 233 and 237 of the partition member 230 with respect to the force-fit clamps 252 according to the height of items stored in the storage space 101 of the extractable container 100. As a result, user convenience and space efficiency are further improved.

The guide members 270 are formed to the first and the second sidewalls 211, 212, 213 and 214 of the frame 210 to guide linear movements of the slide members 250, and may each include a guide groove 271 extended along a horizontal length of the frame 210 and recessed by a predetermined depth.

The slide members 250 may be inserted in and moved along the guide groove 271. However, rollers 255 may be rotatably mounted within the slide member 250 to be in rolling-contact with upper and lower inner surfaces of the guide groove 271, as shown in FIG. 15.

Figure 16:
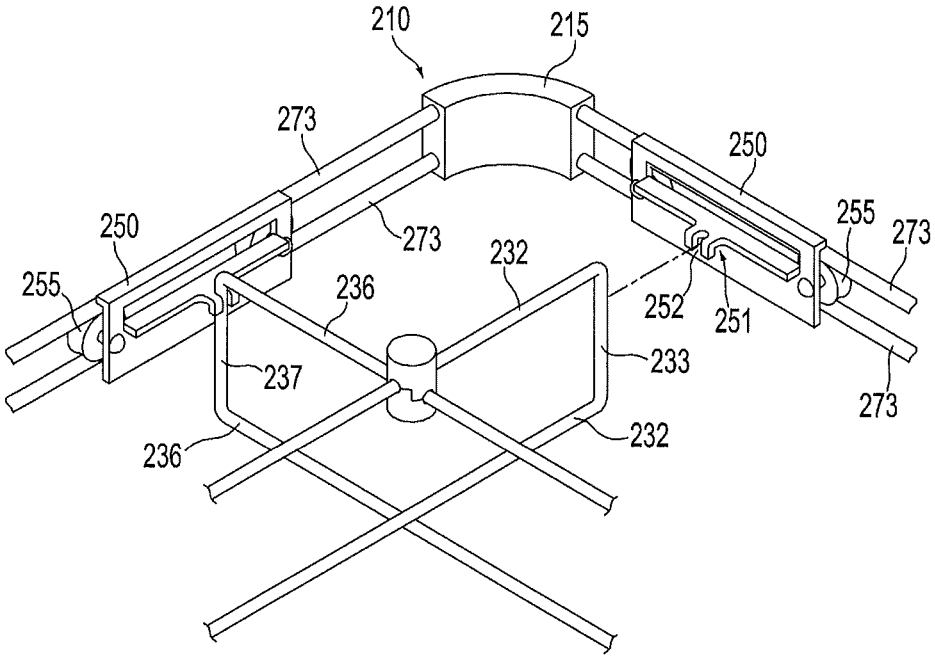
FIG. 16 is a view showing the relationship between a guide member and a slide member of the partition unit, according to the embodiment of FIG. 13.

In addition, as shown in FIG. 16, each of the guide members 270 may further include a pair of guide shafts 273 extended along the horizontal length of the frame 210 to face each other at a vertical interval, and disposed at positions corresponding to the first and the second sidewalls 211, 212, 213 and 214 of the frame 210.

The rollers 255 rotatably connected with the slide member 250 are disposed between the pair of guide shafts 273 in rolling-contact with the pair of guide shafts 273. According to this, the slide member 250 is linearly moved along the guide shafts 273.

Although the guide member 270 includes the guide groove 271 or the pair of guide shafts 273 while the slide member 250 includes the rollers 255 in rolling-contact with the guide groove 271 or the guide shafts 273 according to FIGS. 15 and 16, this embodiment is suggested only by way of example. Therefore, any other structures may be formed on the first and the second sidewalls 211, 212, 213 and 214 of the frame 210 so long as such structures enable the guide member 270 to guide the linear movement of the slide member 250.

Also, the sliding member 250 removably connected to the partition member 230 in the embodiment of FIG. 15 may be integrally formed with the partition member 230.

Referring to FIG. 14, when the partition unit 200 constructed into a single assembly as described above is properly received in the storage space 101 of the extractable container 100, at least a part of the frame 210 may be covered by a cover member 300 connected to an upper circumference of the extractable container 100.

For this structure, a seating part 107 may be formed at an inside of the vertical wall 105 extended upward from the circumference of the bottom surface 103, thereby forming the storage space 101 of the extractable container 100, so that the frame 210 of the partition unit 200 is supported and seated on the seating part 107.

The seating part 107 is protruded out from the inside of the vertical wall 105 of the extractable container 100 into a shape corresponding to the circumference of the frame 210, so as to support a lower surface of the frame 210 of the partition unit 200.

When the partition unit 200 is inserted from the upper part of the storage space 101 of the extractable container 100, the lower surface of the frame 210 is supported by the seating part 107. Accordingly, the partition unit 200 is safely supported in the storage space 101.

Figure 17:
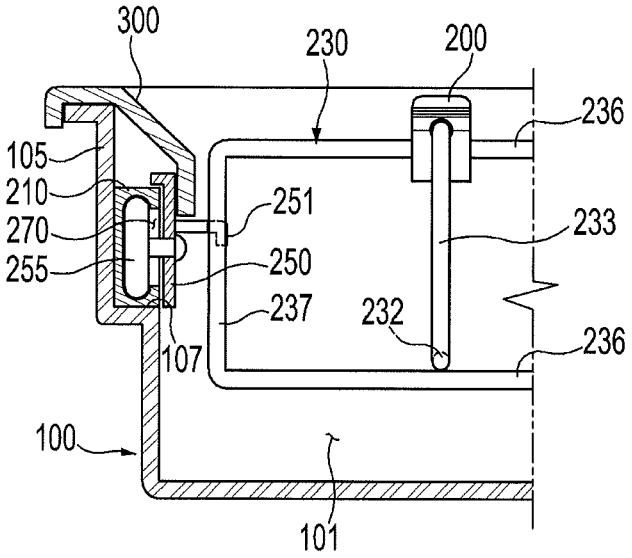
FIG. 17 is a cross-sectional view taken along the line A-A of FIG. 13.

The cover member 300 may be connected to the upper circumference of the extractable container 100 to enclose part of the frame 210 as shown in FIG. 17, in order to prevent the frame 210 seated on the seating part 107 from being exposed in the storage space 101 and also being separated from the extractable container 100.

The cover member 300 is shaped corresponding to the circumference of the extractable container 100, and therefore is force-fitted with the inside of the vertical wall 105 forming the storage space 101 of the extractable container 100. The cover member 300 may be removably connected to the extractable container 100 through a dedicated connection member (not shown).

Thus, the frame 210 of the partition unit 200 is not exposed in the storage space 101, accordingly improving aesthetics. In addition, the movement stability is improved since entrance of foreign substances to the guide members 270 guiding the movements of the slide members 250 is reduced.

Furthermore, the guide members 270 and the slide members 250 will be less likely to interfere with items stored in the storage space 101 due to the presence of the cover member 300. Therefore, damage of the items is reduced while further improving the space efficiency of the storage space 101.

Figure 18:
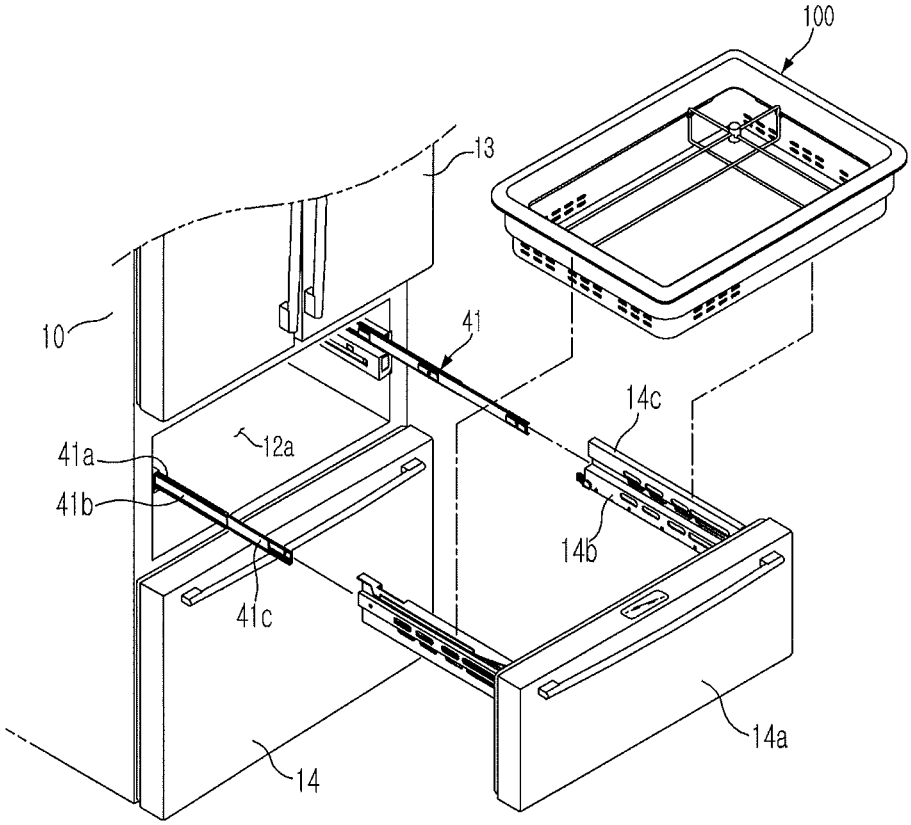
FIG. 18 is an exploded perspective view showing a drawer type extractable container in a refrigerator according to another embodiment of the present invention in a state of being withdrawn from the refrigerator.
Figure 19:
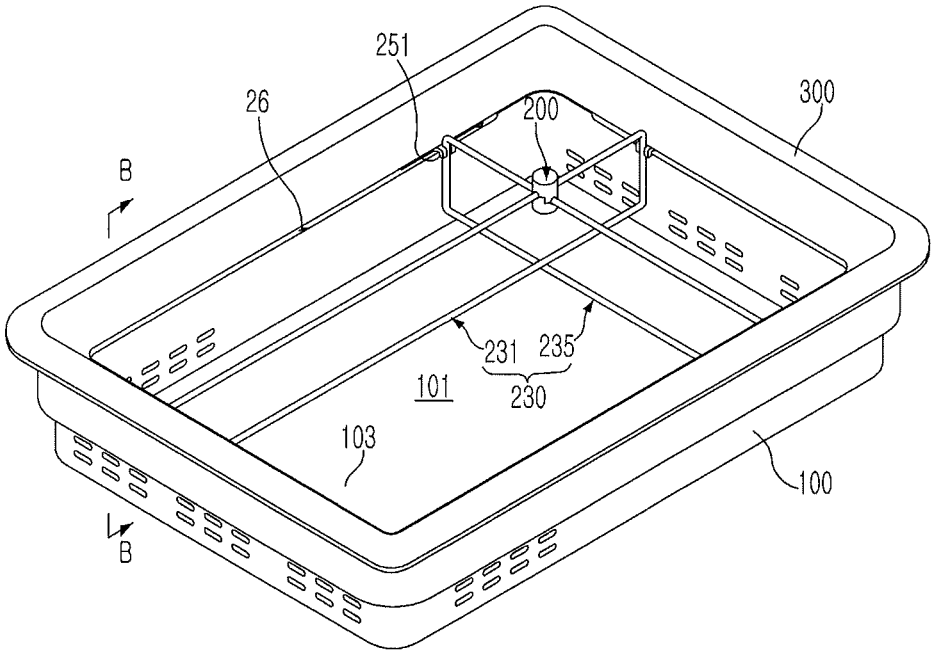
FIG. 19 is a perspective view showing the drawer type extractable container shown in FIG. 18.
Figure 20:
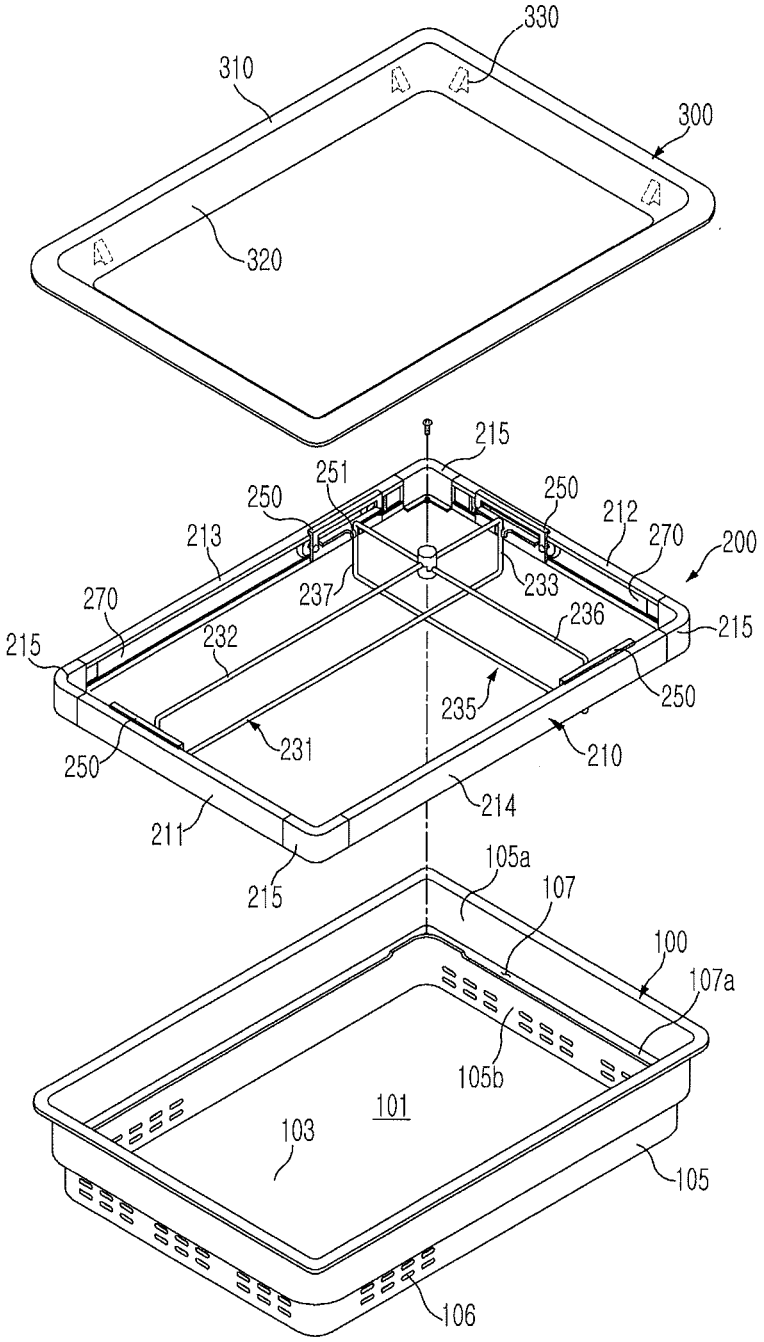
FIG. 20 is an exploded perspective view of the drawer type extractable container shown in FIG. 19.
Figure 21:
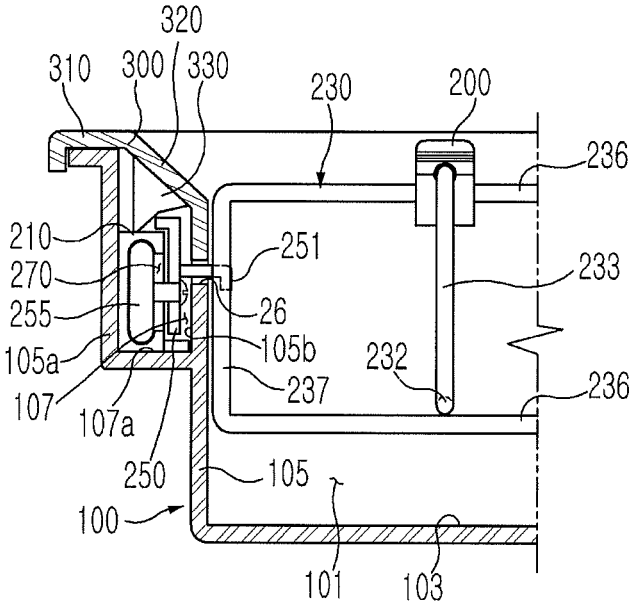
FIG. 21 is a cross-sectional view taken along the line A-A of FIG. 18.

FIG. 18 shows a drawer type extractable container in a refrigerator according to another embodiment of the present invention in a state of being withdrawn from the refrigerator. FIG. 19 is a perspective view showing the drawer type extractable container shown in FIG. 18. FIG. 20 is an exploded perspective view of the drawer type extractable container shown in FIG. 19. FIG. 21 is a cross-sectional view taken along the line A-A of FIG. 18.

In the refrigerator according to this embodiment, the door to open or close the storage chamber is of a drawer type. The extractable door is detachably mounted to the door. This configuration will be described hereinafter.

Referring to FIG. 18, the refrigerator according to this embodiment includes a body 10, doors 13 pivotally coupled to left and right sides of the body 10, respectively, to open or close a first storage chamber (not shown) provided at an upper portion of the body 10, a door 14 to open or close a second storage chamber (not shown) provided at a lower portion of the body 10, and a door 14*a* to open or close a third storage chamber 12*a* provided between the first storage chamber and the second storage chamber.

The first storage chamber, second storage chamber, and third storage chamber 12*a* are partitioned by insulating partition walls, to form independent storage spaces, respectively. The storage temperatures of the storage chambers may be independently controlled in accordance with the amounts of cold air supplied to the storage chambers, respectively.

The door 14*a* to open or close the third storage chamber 12*a* may be of a drawer type such that the door 14*a* is slidably movable in forward and backward directions of the third storage chamber 12*a*.

An extractable container 100 is detachably mounted to the door 14*a*. When the door 14*a* is opened, the extractable container 100 is forwardly withdrawn, in order to allow the user to easily store or take out food, etc.

To this end, seat frames 14*b*, on which the extractable container 100 will be seated, are provided at opposite sides of a back surface of the door 14*a*, respectively. The seat frames 14*b* may be fixed to sliding units 41 mounted to opposite side walls of the third storage chamber 12*a*, respectively.

The seat frames 14*b* extend backwards from the back surface of the door 14*a*, to provide support surfaces 14*c* on which the extractable container 100 will be seated, to be supported by the seat frames 14*b*.

Each sliding unit 41 includes a first rail 41*a* fixed to the corresponding side wall of the third storage chamber 12*a*, a second rail 41*b* slidably mounted to the first rail 41*a* such that the second rail 41*b* is movable with respect to the first rail 41*a*, and a third rail 41*c* mounted to the second rail 41*b* such that the third rail 41*c* is movable with respect to the second rail 41*b*. The second rail 41*b* has a width to allow the second rail 41*b* to be slidably fitted into the first rail 41*a*. The third rail 41*c* has a width to allow the third rail 41*c* to be slidably fitted into the second rail 41*b*. Thus, the sliding unit 41 has a triple rail structure.

Accordingly, the door 14*a* is mounted to the body 10 by the sliding units 41 such that the door 14*a* is slidably movable in forward and backward directions of the body 10. The extractable container 100 may be detachably mounted to the seat frames 14*b* of the door 14*a*.

Referring to FIG. 19, the extractable container 100, which is detachably mounted to the seat frames 14*b* of the door 14*a*, may include a partition unit to divide a storage space 101, as in the extractable container 100 described in conjunction with FIG. 13. In the following description, constituent elements having the same function will be designated by the same reference numeral, and no detailed description thereof will be given.

The partition unit 200 includes a partition member 230 to divide the storage space 101 into one or more spaces, and a conveying unit to guide movement of the partition member 230. The conveying unit includes guide members 270 and sliding members 250.

The extractable container 100 shown in FIG. 19 is different from that of the previous embodiment in terms of the structure of the seat on which the frame 210 of the partition unit 200 is seated, in order to allow the partition member 230 to be more stably movable, and to prevent the frame 210 of the partition unit 200 from being outwardly exposed, and thus to achieve an enhancement in aesthetic appearance.

Referring to FIGS. 20 and 21, the extractable container 100 may include a bottom surface 103, a vertical wall 105 extended upward from a circumference of the bottom surface 103, thereby forming the storage space 101. A seating part 107 may be provided at the vertical wall 105, to seat the frame 210 of the partition unit 200 thereon. Cold air holes 106 may be provided at the vertical wall 105, to guide introduction of cold air into the storage space 101.

The seating part 107 may include a step 107*a* extended outward from the vertical wall 105, and outer and inner side walls 105*a* and 105*b* respectively extended upward at opposite ends of the step 107*a*. The seating part 107 may also include a receiving groove 107*a* formed along a circumference of the vertical wall 105 between the outer and inner side walls 105*a* and 105*b*.

The inner side wall 105*b* has a lower height than the outer side wall 105*a*. However, the inner side wall 105*b* may extend upward to positions near the connection parts 251 of the sliding members 250, to which vertical rods 233 and 237 of the partition member 230 are connected, respectively, under the condition that the frame 210 of the partition unit 200 is received in the receiving groove 107*a*.

A guide slot 26 may be centrally provided at an upper end of each side of the inner side wall 105*b*. The guide slot 26 is upwardly opened while being horizontally extended. The opened upper portion of the guide slot 26 may be closed by a cover member 300, which is coupled to the top of the extractable container 100.

When the frame 210 is seated in the receiving groove 107*a*, the connection part 251 extended from each sliding member 250 is protruded into the storage space 101 through the corresponding guide slot 26. The connection part 251 protruded through the guide slot 26 may be connected to the partition member 230.

The cover member 300 may include an upper part 310 having a shape corresponding to the circumference of the extractable container 100, and a cover part 320 extended from the upper part 310 while being downwardly inclined.

When the cover member 300 is coupled to the top of the extractable container 100, the upper part 310 thereof is supported by the upper end of the outer side wall 105*a* in a seated state. The lower end of the cover part 320 is supported by the upper end of the inner side wall 105*b* in a seated state.

Accordingly, the cover part 320 covers the frame 210 received in the receiving groove 107, thereby preventing the frame 210 from being exposed in an outward direction of the extractable container 100.

Meanwhile, at least one support rib 330 may be provided at an inner surface of the cover part 230. The support ribs 330 may press the frame 210, on which the guide members 270 are formed, in order to allow the sliding members 250 to stably move along the guide members 270.

The at least one support rib 330 may comprise a plurality of support ribs each extended from the inner surface of the cover part 230 while being downwardly inclined, to press an upper surface of the frame 210 at one end thereof.

As is apparent from the above description, a partition unit of an extractable container for a refrigerator according to the embodiments may efficiently divide a storage space of the extractable container according to quantities of stored food, through a simple operation. Thus, the user convenience is improved.

Furthermore, since a conveying unit to move partition members that divide the storage space is not exposed to the outside, the aesthetics of the extractable container are improved while minimizing scratches that may be generated as the partition members are moving.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A refrigerator comprising:

a storage chamber;

a drawer type door slidably movable to open or close the storage chamber;

an extractable container detachably mounted to the drawer type door, the extractable container comprising a vertical wall having inner and outer side walls spaced apart from each other, and a receiving groove defined between the inner and outer side walls, and a storage space defined by the vertical wall;

a partition unit comprising a rectangular frame centrally opened and seated in the receiving groove, a first partition member crossing the storage space in a first direction with both ends thereof supported by the first facing sidewalls of the rectangular frame, a second partition member crossing the storage space in a second direction intersecting the first direction with both ends thereof supported by the second facing sidewalls of the rectangular frame, a plurality of slide members respectively formed at both ends of the first and the second partition members, and a plurality of guide members respectively formed at the first and the second sidewalls of the rectangular frame; and a cover member coupled to a circumference of the vertical wall, to cover a top of the receiving groove, thereby preventing the rectangular frame seated in the receiving groove from being outwardly exposed, wherein the guide members are integrally formed with the rectangular frame.

2. The refrigerator according to claim 1, wherein the cover member comprises at least one support rib to press one side of the rectangular frame seated in the receiving groove.

3. The refrigerator according to claim 1, wherein the guide members each comprise a guide groove extended along a horizontal length of the rectangular frame, and the slide members each comprise a roller received in the guide groove to be in rolling-contact with an inside of the guide groove.

4. The refrigerator according to claim 1, wherein the first and the second partition members each comprise horizontal rods spaced vertically and facing each other, and vertical rods connecting both ends of the respective horizontal rods, thereby forming a rectangular closed curve, and the slide member comprises connection parts to which the vertical rods are connected.

5. The refrigerator according to claim 1, further comprising:

a handle part disposed at an intersection between the first partition member and the second partition member to guide the first partition member in the forward and the backward directions and the second partition member in the left and the right directions.

* * * * *